United States Patent [19]

Petrescue

[11] 4,224,921

[45] Sep. 30, 1980

[54] FIREPLACE WITH AIR CONTROL DAMPERS

[75] Inventor: Bernard Petrescue, Pilot Butte, Canada

[73] Assignee: Berwin Development Ltd., Kelowna, Canada

[21] Appl. No.: 2,222

[22] Filed: Jan. 9, 1979

[30] Foreign Application Priority Data

Sep. 22, 1978 [CA] Canada ..... 311686

[51] Int. Cl.[3] ..... F24B 7/00

[52] U.S. Cl. ..... 126/121; 126/288; 126/120

[58] Field of Search ..... 126/120, 121, 122, 131, 126/129, 143, 288, 85 B; 98/36; 237/51

[56] References Cited

U.S. PATENT DOCUMENTS

| | | | |
|---|---|---|---|
| 4,108,144 | 8/1978 | Wilhoite | 126/120 |
| 4,117,827 | 10/1978 | Billmeyer | 126/288 X |
| 4,153,036 | 5/1979 | Billmeyer | 126/121 |
| 4,169,458 | 10/1979 | Shaw | 126/120 |
| 4,170,219 | 10/1979 | Hansen et al. | 126/121 |

*Primary Examiner*—George T. Hall
*Attorney, Agent, or Firm*—Stanley G. Ade

[57] ABSTRACT

A fireplace includes a controlled external air intake and means to preheat this air during its passage to the firebox through a heat exchanger system. This heated air also passes into the room in which the fireplace is situated. This air routing is fully controlled by dampers and when entering the room may induce a slight positive pressure within the room rather than the negative pressure caused when combustion air is drawn from the room. A chimney damper is provided with a plurality of positions and when fully closed, seals off the chimney so that cold air cannot flow down the chimney and into the room. The outer skin or shell is insulated thus enabling installation with relatively little clearance and glass closure doors may be used to close off the front of the grate area from the room thereby preventing air from being drawn from the room and also preventing ashes, cinders or the like from falling from the firebox component.

14 Claims, 14 Drawing Figures

FIREPLACE WITH AIR CONTROL DAMPERS

BACKGROUND OF THE INVENTION

Conventional fireplaces often draw combustion air from the room within the house in which they are situated and this is not only expensive because the air is usually preheated by the furnace system but also, with present day relatively well sealed houses, can cause an area of negative pressure to occur with the subsequent difficulties of smoke backing up from the fireplace. Also when the fireplace is used in a well sealed area, the air has to be drawn from such sources as sewer drain outlets (via the weeping tiles), clothes dryer outlets, and under certain circumstances, from the chimney of the conventional furnace. In conjunction with the furnace chimney, the quantity of air used by a fircely burning fireplace is sufficient that it can reverse the flow of the furnace chimney and draw the gases of combustion into the house with often dangerous results.

Another disadvantage of conventional fireplaces is that sparks and ashes often discharge therefrom onto carpets and floors and cold air enters the room through the fireplace chimney when same is not in use due to the inefficiency of conventional dampers.

The thermal efficiency of conventional fireplaces is usually extremely low and it is difficult to control the speed of consumption of wood and other products in the fireplace so that smoke produced by combustion at temperatures lower than optimum combustion (because of rapid fuel consumption) often result in undesirable and unnecessary pollution.

SUMMARY OF THE INVENTION

The present invention overcomes these disadvantages by providing a fireplace in which the combustion air is drawn from a location remote from the interior of the house and which can be sealed off when the fireplace is not in use. The air is then drawn into a heat exchange system where the required amount may be used for combustion and the remainder may be circulated into the room in which the fireplace is situated.

One aspect of the invention consists of a fireplace assembly comprising in combination an outer shell and a firebox component therein, a flue exit communicating with said component and air intake means for said assembly, means between said outer shell and said firebox component selectively to convey air from said air intake means to said component, means to control air to said firebox component, means to convey said air from said air intake means to the exterior of said outer shell, means between said outer shell and said firebox component to convey heat from said firebox component to said air in order to preheat said air when said fireplace is operating and damper means to control the flow of combustion gases through said flue exit, said damper means also closing off said flue exit when in the closed position.

If desired, various dampers may be provided in order to control the combustion air and hence the speed of combustion and the chimney damper is of a design which enables same to be shut down completely thereby preventing cold air from passing down the chimney and into the room when the fireplace is not in use.

Another advantage of the present invention is to provide a device of the character herewithin described which provides an efficient enclosed fireplace which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 2:
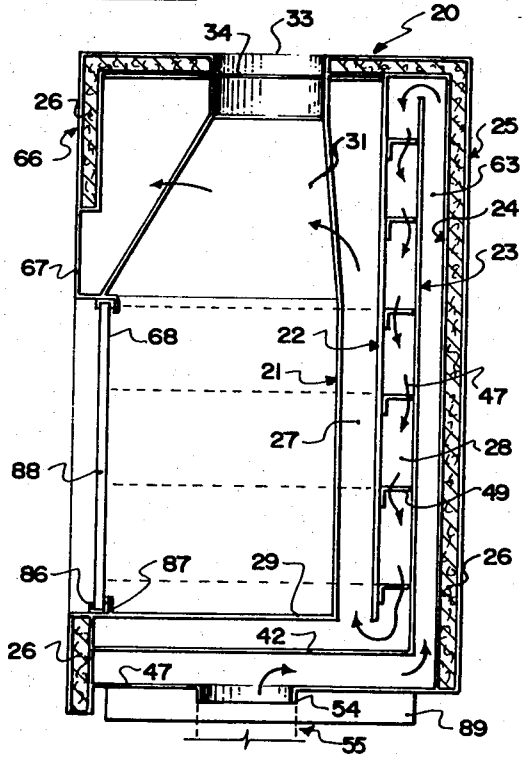
FIG. 2 is a vertical section of FIG. 1.
Figure 1:
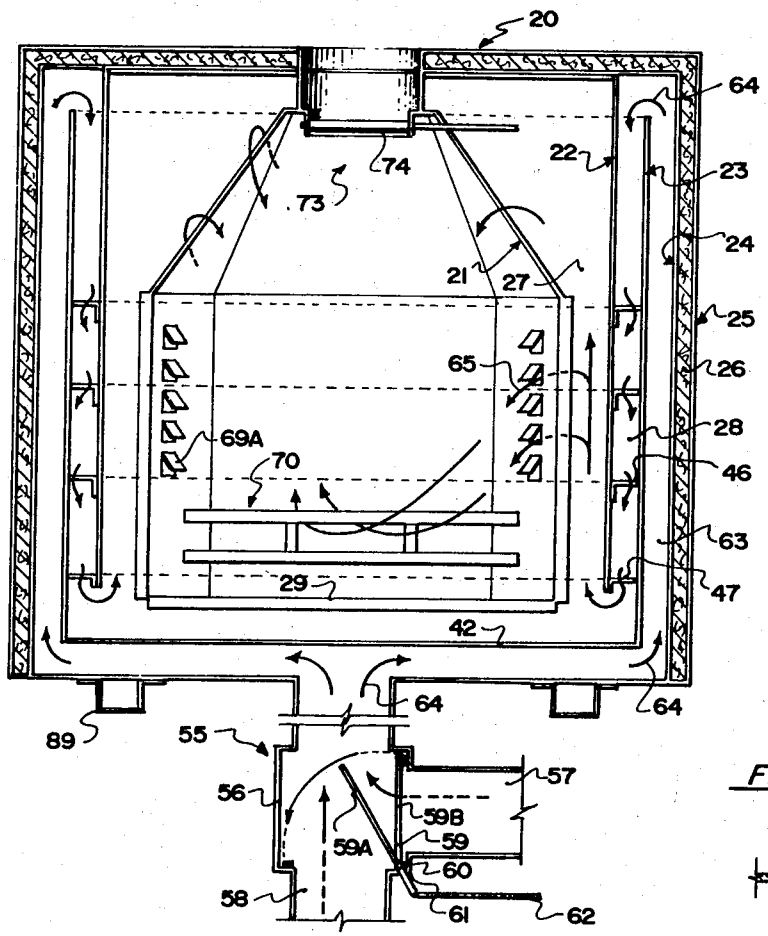
FIG. 1 is a front vertical section of the assembled fireplace.

Proceeding therefore to describe the invention in detail, reference should first be made to FIGS. 1 and 2 in which reference character 20 illustrates the fireplace consisting of a firebox component collectively designated 21, a first casing collectively designated 22 and situated around the firebox component in spaced and substantially parallel relationship, a second casing collectively designated 23 surrounding and being spaced from the first casing 22, an outer casing collectively designated 24 and an outer shell collectively designated 25 with insulation material 26 being situated between the outer casing 24 and the outer shell 25. The outer shell 25 may be covered with decorative panels (not illustrated) to give a finished appearance to the completed fireplace.

The spaced apart reltionship of the firebox component 21 and the first casing 22 defines a space or channel 27 therebetween and the spacing between the first and second casings 22 and 23 defines a second space therebetween identified by reference character 28.

Dealing first with the firebox component 21, it includes a base panel 29, a pair of vertical side walls 30 which incline inwardly and rearwardly to a rear wall 31 thus forming a box with an open front, and being surmounted by a hood portion 31 in the form of a truncated pyramid terminating in the upper side 32 within which a circular aperture 33 is provided with an outstanding collar 34 to be attached to a chimney (not illustrated).

A conventional fire grate (not illustrated) is adapted to rest upon the floor or base 29 and may be hooked to angulated hooks 35 secured to and extending inwardly from the rear wall 31.

The front edges of the side walls 30 terminate in off-standing flanges 36 and the upper horizontal edge between the upper ends of the fronts of the side walls and the hood 31 is also provided with an outturned flange 36A.

Figure 9:
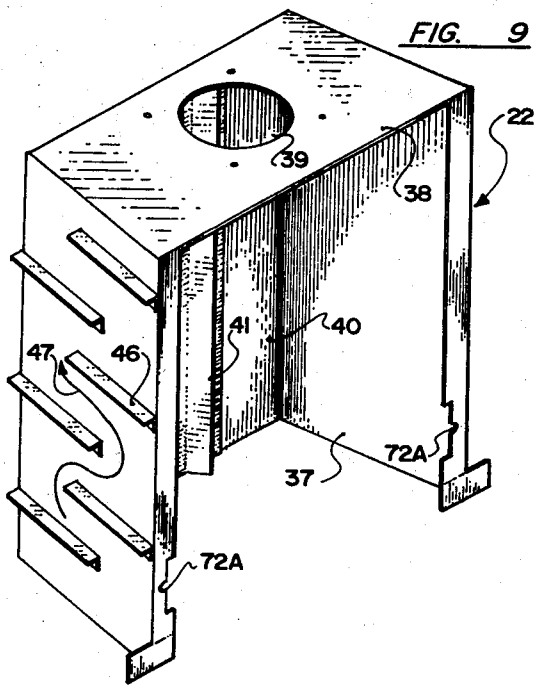
FIG. 9 is an isometric view of the first casing surrounding the firebox component.

FIG. 9 illustrates a first casing collectively designated 22, surrounding the firebox in spaced relationship therefrom, said first casing including an open base, a pair of vertically situated side walls 37 which incline rearwardly and inwardly, and a planar upper wall 38 being apertured as at 39 to engage over the collar 34 of the flue aperture 33. Means are provided to maintain the spaced apart relationship of the first casing 22 relative to the firebox component 21. Insofar as the rear wall 40 is concerned, a vertical rib 41 is situated on the inner surface thereof which engages against the outer surface of the rear wall 31 of the firebox. A plurality of vertically situated fins 43 (see FIG. 3) are secured to and extending outwardly from the outer surfaces of the side walls 30 and the rear walls 31 of the firebox component although only those fins on the lefthand side wall are illustrated. These fins not only act as heat exchanger fins but also maintain the desired spacing between the side walls 30 of the firebox and the side walls 37 of the first casing 22 yet still permit vertical movement therebetween as will hereinafter be described. The collar 34, in conjunction with other spacers (not illustrated) maintain the upper wall 38 of the first casing spaced above the upper wall 32 of the firebox thus defining the aformentioned space 27 between the two components 21 and 22.

Figure 10:
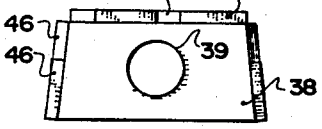
FIG. 10 is a top plan view of FIG. 9 reduced in scale with respect thereof.
Figure 11:
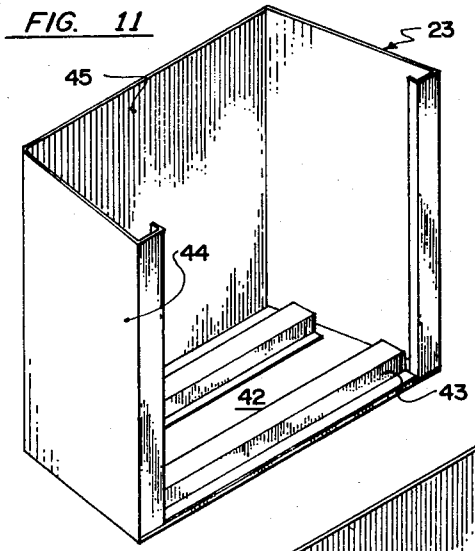
FIG. 11 is an isometric view of the second casing surrounding the first casing.

The firebox 21 together with the open based first casing 22 rest upon cross members 42 extending across the closed base 43 of a second casing 23 illustrated in FIG. 11 and this second casing also includes vertically situated side walls 44 which incline rearwardly and inwardly terminating in the rear wall 45. This second casing is maintained in spaced apart relationship from the first casing to define the second space 28 and in this connection reference should be made to FIGS. 9 and 10.

Both sides and rear panels 37 and 40 are provided with outwardly flanged fins or angles 46 which are welded to the outer surfaces of the sides 37 and extend outwardly therefrom in staggered array to form a serpentine path 47. Vertical angles 48 are secured to the outer surface of the rear wall 40 and further angled fins 49 are welded to these and extend therefrom once again to form vertically situated serpentine paths and these angles 46 and 49 engage against the inner surfaces of the walls 44 and 45 of the second casing thereby forming a form of heat exchanger between the interior of the firebox and the air passageways 27 and 28.

It will be noted that because the lower edges of the first casing 22 rest across the ribs 43 of the second casing, these lower edges are spaced above the base 42 of the second casing. The outer casing collectively designated 24 surrounds the second casing 23, the base 42 of which rests upon ribs or channels 46 extending upwardly from the base 47 of the outer casing and this outer casing includes the base 47, the pair of vertical sides 48 extending upwardly therefrom and inclining inwardly and rearwardly, the rear panel 49 and the upper side 50 which is apertured as at 51 to engage over the aforementioned collar 34 of the flue outlet 33.

Figure 14:
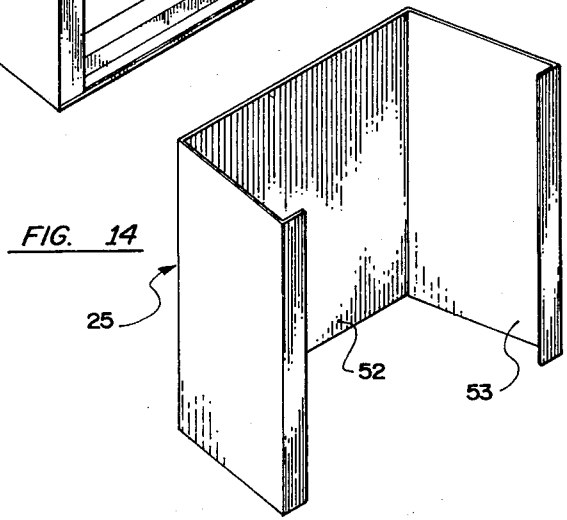
FIG. 14 is an isometric view of the outer shell.

Insulation preferably in the form of slabs 26, surrounds this outer casing 24 and an outer shell 25 enclosed this insulation as clearly shown in FIG. 1. The outer shell, shown in FIG. 14, includes the rear panel 52 and the two side panels 53 which incline inwardly and rearwardly from the front. Decorative panels (not illustrated) may cover the outer shell depending upon design parameters.

The various casings are held together by the flanges illustrated and metal screws or clips or the like (not illustrated).

It will be observed that the flanged aperture 54 is formed in the base of the outer casing 24 communicating with the space between this base 47 and the base 43 of the second casing due to the fact that the outer casing is resting on the cross ribs 43 and reference to FIG. 1 will show that an air intake means collectively designated 55 is connected to this flanged aperture 54 in order to provide remote air intake means to the fireplace.

In this particular embodiment, the air intake means 55 includes an air control box 56 having a cold inlet 57 extending exteriorly of the building (not illustrated) and an inside air intake 58. A double damper assembly 59 is hinged as at 60 to one corner 61 of the box 56 and is actuated by a push pull bowden type cable assembly 62 from a location adjacent the fireplace.

When in the position shown in FIG. 1, the outside air duct is closed and air can be drawn through the inside duct if desired.

However, under normal operating conditions, the damper is moved so that the plate specifically designated 59A moves downwardly to close off the inside air duct 58 and this also opens the other plate specifically designated 59B so that the outside air ducts 57 is connected to the air intake means 55 and then to the air intake aperture 54 within the outer casing 24.

The air then flows horizontally between the floor or base 47 of the outer casing and the floor or base 42 of the second casing to the sides and rear thereof and then flows upwardly between the outer casing and the second casing through the space therebetween specifically designated 63, said air moving between the pairs of side panels and the pair of rear panels.

The upper edges of the second casing terminate spaced from the upperside 50 of the outer casing thus leaving a space over which the air may pass as indicated by arrows 64 in FIG. 1. The air then flows downwardly over the hood portion of the first casing 22 and thence through the serpentine space 28 formed between the first and second casing 22 and 23 to the lower sides and rear of this space 28, the lower edges of which are spaced above the base 42 of the second casing 23 because of the cross ribs 43. The air then flows under the lower edges and rear edge of the first casing 22 and upwardly between the first casing 22 and the exterior of the firebox 21 with part of the air entering the firebox as will hereinafter be described and as indicated by arrows 65, and part of the air continuing upwardly in the space between the hood 31 of the firebox and the upper portion of the first casing 22.

The upper front wall portion 66 of the outer shell is also insulated as indicated by reference character 26 and is provided with a transverse grill 67 situated above the firebox opening indicated by reference character 68.

This grill is preferably formed with filtering material or porous material through which warm fresh air emerges when the fireplace is operating.

Figure 3:
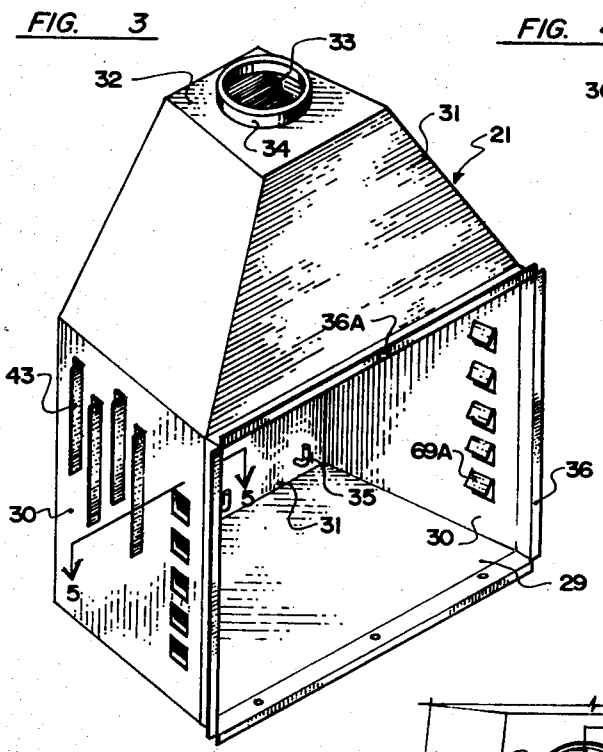
FIG. 3 is an isometric view of the firebox component per se.

Referring back to the means communicating between space 27 and the interior of the firebox, reference to FIGS. 1 and 3 will show that a plurality of apertures 69 are formed in the side walls 30 of the firebox in vertical array adjacent the front flanges 36 thereof. These apertures which are rectangular in the present embodiment, are formed by cutting three sides of the square and bending the tabs 69A in an inwardly and downwardly inclining direction as clearly shown thus directing air downwardly towards the grate shown schematically in FIG. 1 by reference character 70.

Figure 5:
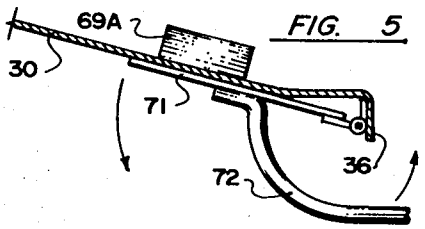
FIG. 5 is a top plan partially sectioned view of FIG. 4 taken along the line 5—5 of FIG. 3.
Figure 4:
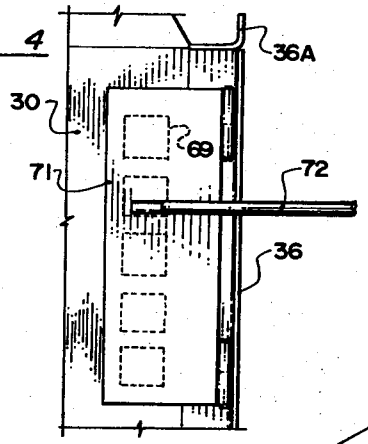
FIG. 4 is a fragmentary side elevation of one side of the firebox component showing the side damper assembly.

FIGS. 4 and 5 show the control damper device for these side apertures. It consists of a substantially rectangular vertical damper panel 71 hinged to the outturned flange 36 of the side walls 30 and, when closed, completely covering the apertures 69 as clearly shown in FIG. 5.

An operating handle 72 extends from the panel 71, through cutouts 72A in the front of the first casing (see FIG. 9) and through apertures (not illustrated) in the front wall on the fireplace so that it can be reached readily one upon each side of the fireplace opening 68. By controlling the degree of opening of this damper panel 71, the amount of air entering the firebox component is controlled.

Figure 8:
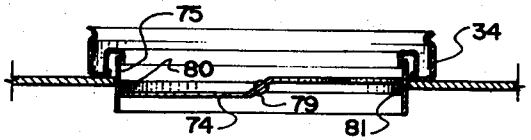
FIG. 8 is a cross sectional view of the damper substantially along the line 8—8 of FIG. 6.
Figure 6:
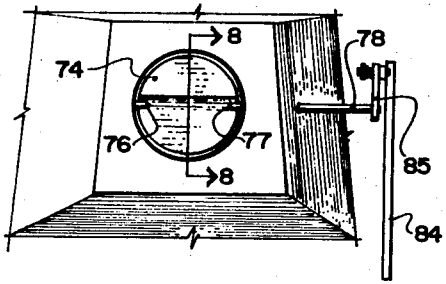
FIG. 6 is a fragmentary top plan view of the firebox component showing details of the damper control.
Figure 7:
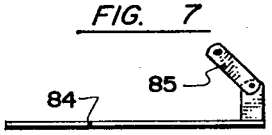
FIG. 7 is a fragmentary front elevation of the damper control per se.

A flue damper assembly is provided collectively designated 73. This flue damper is shown in FIG. 1 and in detail in FIGS. 6, 7 and 8. It consists of an angulated damper plate 74 pivoted within wall of an angular sleeve 75 extending downwardly from the collar or flange 34. One side of the pivot is provided with a relatively short stub shaft 76 and the other side by a stub shaft 77 onto which the slotted end of a damper control rod 78 engages so that rotation of the rod 78 rotates the damper plate 74 from the fully closed positions shown in FIG. 8 to the fully opened position which is at right angles to the position shown in FIG. 8. It will be noted that the damper plate is angulated centrally as at 79 and that when closed, the outer annular edge of one half of the damper engages a semicircular stop plate 80 and the other half engages a semicircular stop plate 81 above and below the stop plates as clearly shown in FIG. 8 thus making an efficient seal when closed in order to prevent cold air from flowing downwardly through the chimney and into the fireplace area.

The control is by means of a further manually operated lever 82 riding in a horizontal slot 83 in the front of the fireplace above the fireplace opening 68, said rod having a forked inner end and engaging the swing rod 84 which is connected by pivotal linkage 85 to the aforementioned rod 78. The slot 83 is preferably provided with various notches (not illustrated) allowing the control lever 82 to register in anyone of a plurality of positions or to be fully open or fully closed as desired.

Finally it should be noted that upper and lower slide channels 86 are situated within upper and lower flanged edges 87 of the fireplace opening 68 and tempered glass doors 88 are slidably engageable therein so that access can be obtained to the interior of the fireplace yet which enables the front opening 68 to be completely closed off if desired. Such structure is conventional and is not believed necessary to show further detail. It will also be appreciated that screening may be provided instead of the glass doors, if desired.

In operation, and assuming that a fire is being lighted within the grate 70 of the firebox component 21, the flue damper is opened to the fully open position by means of damper control 82. The air intake damper 59 is also manipulated so that the outside air duct is connected to the air intake aperture 54 within the outer casing 24.

The action of the fire within the firebox, causes air to be drawn through the outside air duct 57 and thence into the space between the base of the outer casing and the base of the second casing 23 whereupon it flows upwardly along both sides and the rear of the fireplace through the space 63 defined by the outer casing 24 and the second casing 23.

It passes over the other edge of the second casing 23 and thence downwardly through space 28 following a serpentine course and picking up heat from the angle members 46 and 49.

It then passes downwardly under the lower edges of the first casing 22 and thence upwardly between the first casing and the firebox component once again picking up heat from the vertical angles 43. If the damper controls 71 are closed, air does not pass into the fireplace component so that the only air is drawn in from the fireplace opening 68. However normally these damper plates 71 will either be partially or fully opened thus uncovering the air intake apertures 69 so that part of the air moving upwardly within space 27, is deflected into the interior of the firebox component and directed by the tabs 69A, downwardly towards the grate 70. The remaining air passes upwardly through the space 27 picking up heat as it goes and is discharged through the horizontally situated grill 67 in the front of the fireplace just above the fireplace opening 68.

Once the fire is burning in a satisfactory manner, the rate of burning can be controlled by the flue damper assembly 73 together with the side damper plates 71.

When the fireplace is not in use, the flue damper assembly 73 may be fully closed thus sealing off the flue and preventing cold air from flowing downwardly into the fireplace and thence into the room within which it is situated. Also the damper assembly 59 is moved to close off the outside air duct and to open the inside air duct if such duct is required.

Figure 13:
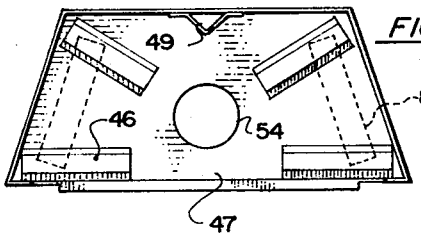
FIG. 13 is a top plan view of FIG. 12.
Figure 12:
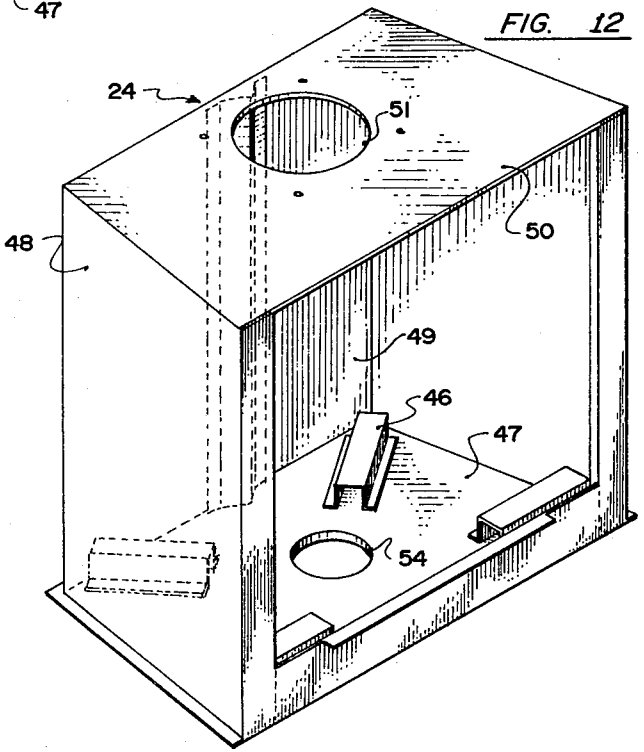
FIG. 12 is an isometric view of the inner wall portion of the outer casing.

Finally the outer shell and the entire fireplace is preferably supported on a pair of channel members 89 situated on the underside of the outer shell as indicated in phantom in FIG. 13 and in front and side elevation in FIGS. 1 and 2.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A fireplace assembly comprising in combination an outer shell and a firebox component therein, a flue exit communicating with said component and air intake means for said assembly, means between said outer shell and said firebox component selectively to convey air from said air intake means to said component, means to control air to said firebox component, means to convey said air from said air intake means to the exterior of said outer shell, means between said outer shell and said firebox component to convey heat from said firebox component to said air in order to preheat said air when said fireplace is operating and damper means to control the flow of combustion gases through said flue exit, said damper means also closing off said flue exit when in the closed position.

2. The assembly according to claim 1 in which said means between said outer shell and said firebox component includes reverse flow channel means formed between said outer shell and said firebox component operatively connecting said air intake means with said firebox component and said means to convey air from said air intake means to the exterior of said outer shell.

3. The component according to claim 2 in which said reverse flow channel means includes a first casing partially surrounding said firebox component in spaced apart relationship to define a first space therebetween and a second casing partially surrounding said first casing in spaced relationship to define a second space therebetween, said air intake means being operatively connected to said second space between said outer shell and said second casing, means operatively connecting said second space to said first space between said firebox and said first casing whereby air flows from said air intake means and through said second space, and then through said first space.

4. The assembly according to claim 2 in which said means between said outer shell and said firebox component to convey heat from said firebox component to said air includes fins extending from said firebox component towards said outer casing and within said reverse flow channel means.

5. The assembly according to claim 2 in which said means between said outer shell and said firebox component to convey heat from said firebox component to said air includes fins extending within said first space from said firebox towards said first casing, said fins being situated in staggered array relative to one another to form a serpentine path for the air flowing therepast.

6. The assembly according to claim 1 in which said means to control air to said firebox component includes a plurality of apertures formed through the side walls of said firebox component and manually operated damper means operatively connected between the exterior of said outer shell and said apertures.

7. The assembly according to claim 2 in which said means to control air to said firebox component includes a plurality of apertures formed through the side walls of said firebox component and manually operated damper means operatively connected between the exterior of said outer shell and said apertures.

8. The assembly according to claim 3 in which said means to control air to said firebox component includes a plurality of apertures formed through the side walls of said firebox component and manually operated damper means operatively connected between the exterior of said outer shell and said apertures.

9. The assembly according to claim 4 in which said means to control air to said firebox component includes a plurality of apertures formed through the side walls of said firebox component and manually operated damper means operatively connected between the exterior of said outer shell and said apertures.

10. The assembly according to claim 5 in which said means to control air to said firebox component includes a plurality of apertures formed through the side walls of said firebox component and manually operated damper means operatively connected between the exterior of said outer shell and said apertures.

11. The assembly according to claims 1, 2 or 3 in which said means to convey air from said air intake means to the exterior of said outer shell includes an exit in said outer shell communicating with said means between said outer shell and said firebox component and a manually operated damper operatively connected to said exit.

12. The assembly according to claims 4, 5 or 6 in which said means to convey air from said air intake means to the exterior of said outer shell includes an exit in said outer shell communicating with said means between said outer shell and said firebox component and a manually operated damper operatively connected to said exit.

13. The assembly according to claims 7, 8 or 9 in which said means to convey air from said air intake means to the exterior of said outer shell includes an exit in said outer shell communicating with said means between said outer shell and said firebox component and a manually operated damper operatively connected to said exit.

14. The assembly according to claim 10 in which said means to convoy air from said air intake means to the exterior of said outer shell includes an exit in said outer shell communicating with said means between said outer shell and said firebox component and a manually operated damper operatively connected to said exit.

* * * * *